United States Patent [19]

Ichinose

[11] 4,084,505

[45] Apr. 18, 1978

[54] DEVICE FOR ADJUSTING PHASE OF FLAT SCREEN

[76] Inventor: Shiro Ichinose, 11-8, 4-chome, Shinohara, Kita-machi, Nada-ku Kobe-shi, Hyogo-ken, Japan

[21] Appl. No.: 695,928

[22] Filed: Jun. 14, 1976

[51] Int. Cl.[2] ..... B41F 15/10; B41F 15/36

[52] U.S. Cl. ..... 101/123; 101/115; 101/124; 101/128.1

[58] Field of Search ..... 101/115, 123, 124, 127.1, 101/128.1, 129

[56] References Cited

U.S. PATENT DOCUMENTS

| | | | |
|---|---|---|---|
| 2,309,914 | 2/1943 | Montague | 101/115 |
| 2,793,586 | 5/1957 | Arelt | 101/123 |
| 2,918,866 | 12/1959 | Reed | 101/124 |
| 3,167,004 | 1/1965 | Miller et al. | 101/127.1 |
| 3,168,036 | 2/1965 | Elsasser | 101/129 |
| 3,650,208 | 3/1972 | Lambert | 101/123 |
| 3,762,318 | 10/1973 | Dubuit | 101/124 |
| 3,910,185 | 10/1975 | Brasa | 101/124 |
| 3,921,519 | 11/1975 | Zimmer | 101/116 |
| 3,926,111 | 12/1975 | Bohm | 101/116 |
| 3,946,668 | 3/1976 | Douthwaite et al. | 101/128.1 X |

FOREIGN PATENT DOCUMENTS

| | | | |
|---|---|---|---|
| 2,001,780 | 7/1971 | Germany | 101/115 |

*Primary Examiner*—Ronald E. Suter
*Attorney, Agent, or Firm*—Sherman & Shalloway

[57] ABSTRACT

A device for adjusting the phase of a flat screen in an automatic flat screen printing machine, which comprises a supporting member for supporting a flat screen, a supporting and driving system for supporting said screen supporting member in such a state that the screen supporting member can be moved in the lengthwise direction of the machine, at least one adjustment screw mechanism for connecting said screen supporting member to said screen supporting and driving system, a phase adjustment driving mechanism for turning said screw mechanism to displace said screen supporting member in the lengthwise direction of the machine.

7 Claims, 3 Drawing Figures

DEVICE FOR ADJUSTING PHASE OF FLAT SCREEN

BACKGROUND OF THE INVENTION

This invention relates to a device for adjusting the phase of a flat screen in an automatic flat screen dye printing or automatic flat screen printing machine. More particularly, the invention relates to a device for adjusting the phase of a flat screen which can perform the phase adjustment of a flat screen independently from the screen driving system and can adjust the phase of a flat screen not only when the printing machine is stopped but also when the printing machine is in operation.

In conventional automatic printing machines, an endless belt for supporting and transporting a material to be printed, such as cloth, is fed intermittently and while the endless belt is stopped, a screen is brought down on the material to be printed, and then, a squeegee member is scanned on the screen to squeeze out a printing paste on the material to be printed and the screen and squeegee member are lifted up and the endless belt is fed again.

In this conventional printing method, problems are involved in intermittent feeding of a material to be printed. For example, in order to register the material to be printed exactly with the screen, it is necessary to use an expensive printing belt (blanket) which has a much reduced tendency to elongate and a belt-stopping mechanism having a very high accuracy, and therefore, the structure of the printing machine is inevitably complicated and its price is very high. Further, when a flexible material is printed, an accurate pattern can hardly be printed because of a tension given when it is transported.

Recently, as a printing method overcoming the foregoing disadvantages, there has been proposed an automatic screen printing method comprising feeding continuously a material to be printed at a constant speed in the longitudinal direction by means of a transporting member, bringing down a printing stencil (screen), which has been positioned above the material to be printed, on the material to be printed to contact the stencil with the material to be printed, moving both the printing stencil and the material to be printed at the same speed in the same direction, squeezing out a printing paste on the material to be printed while the printing stencil travels along a length corresponding to about ½ of the pattern length, lifting up the printing stencil to release its contact with the material to be printed, moving the printing stencil in the reverse direction, and repeating the foregoing operations (see the specification of U.S. Pat. No. 3,168,036).

This automatic printing method is characterized in that a printing operation can be performed while a material to be printed is fed continuously at a constant speed, but the actual working of this printing involves various difficulties. For example, in the automatic screen printing machine of this type, since a screen frame is always reciprocated in the horizontal direction, precise location of the screen is often difficult.

When the screen is not precisely located, patterns of respective repeats are made discontinuous or superimposed. Further, when patterns having a plurality of colors are printed, a plurality of screens corresponding to the number of colors to be printed must be used and in this case, matching of the phases among the screens is very important. If there is a deviation of the phases or relative positions among the screens, a so-called color shear is caused in an obtained print. In the screen printing machine of the above-mentioned type where a material to be printed is continuously fed in the printing zone, the phase adjustment is very difficult and the position or phase of the screen is readily deviated by the reciprocative movement of the screen, and it is often difficult to obtain prints having a precisely registered pattern.

In conventional screen printing machines of the type where a screen is driven, for example, rotary screen printing machines, a phase adjustment mechanism is disposed in a screen driving system and the phase of the screen is adjusted by reducing or increasing the screen driving speed by this phase adjustment mechanism. However, in printing machines of the above-mentioned type where a material to be printed is continuously fed, the operation of moving the screen at the same speed as that of the material in the same direction as that of the material at the printing step, the operation of moving the screen in the reverse direction during the non-printing period, the operation of scanning the squeegee member on the screen at the printing step, the operation of contacting the material to be printed with the screen at the start of the printing step and separating the material from the screen at the completion of the printing step and the operation of continuously feeding the material to be printed at such a speed that the material is moved along a distance corresponding to one repeat length while one cycle of the printing operation is completed must be performed at good timings accordantly with one another. Accordingly, in the printing machines of this type, it is quite difficult to perform the phase adjustment by a phase adjustment mechanism disposed in the screen driving system.

OBJECTS OF THE INVENTION

It is therefore a primary object of the present invention to provide a device for adjusting the phase of a flat screen in a flat screen printing machine of the type where a material to be printed is continuously fed and the printing operation is performed by reciprocating the flat screen in the horizontal direction.

Another object of the present invention is to provide a device for adjusting the phase of a flat screen which can be disposed on a flat screen supporting member independently from a screen driving mechanism and which can perform the phase adjustment independently from driving of the screen.

Still another object of the present invention is to provide a device for adjusting the phase of a screen which can perform the phase adjustment very easily not only when the printing machine is stopped but also when the printing machine is being operated.

A further object of the present invention is to provide a device for adjusting the phase of a flat screen which has a relatively simple structure and can be attached to the screen supporting member in a relatively compact form.

SUMMARY OF THE INVENTION

More specifically, in accordance with the present invention, there is provided a device for adjusting the phase of a flat screen in an automatic flat screen printing machine, which comprises a supporting member for supporting a flat screen, a supporting and driving system for supporting said screen supporting member in such a state that the screen supporting member can be moved in the lengthwise direction of the machine, at least one adjustment screw mechanism for connecting said screen supporting member to said screen supporting and driving system, a phase adjustment driving mechanism for turning said screw mechanism to displace said screen supporting member in the lengthwise direction of the machine.

BRIEF DESCRIPTION OF THE DRAWINGS

This invention will now be described in detail by reference to the accompanying drawings, in which.

DETAILED DESCRIPTION

Figure 1:
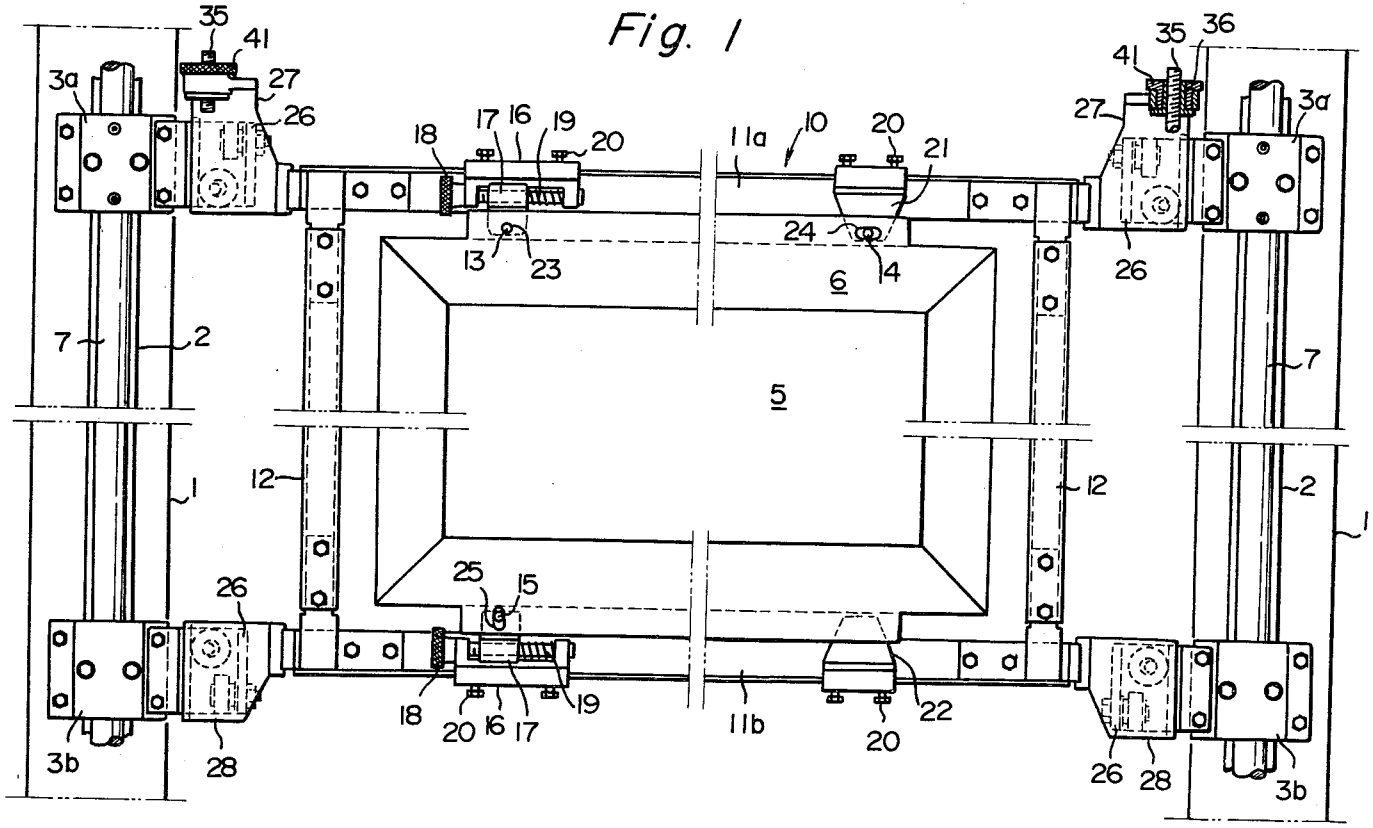
FIG. 1 is a plan view showing an embodiment of the flat screen phase adjustment device of the present invention together with a flat screen supporting device and a driving system.
Figure 2:
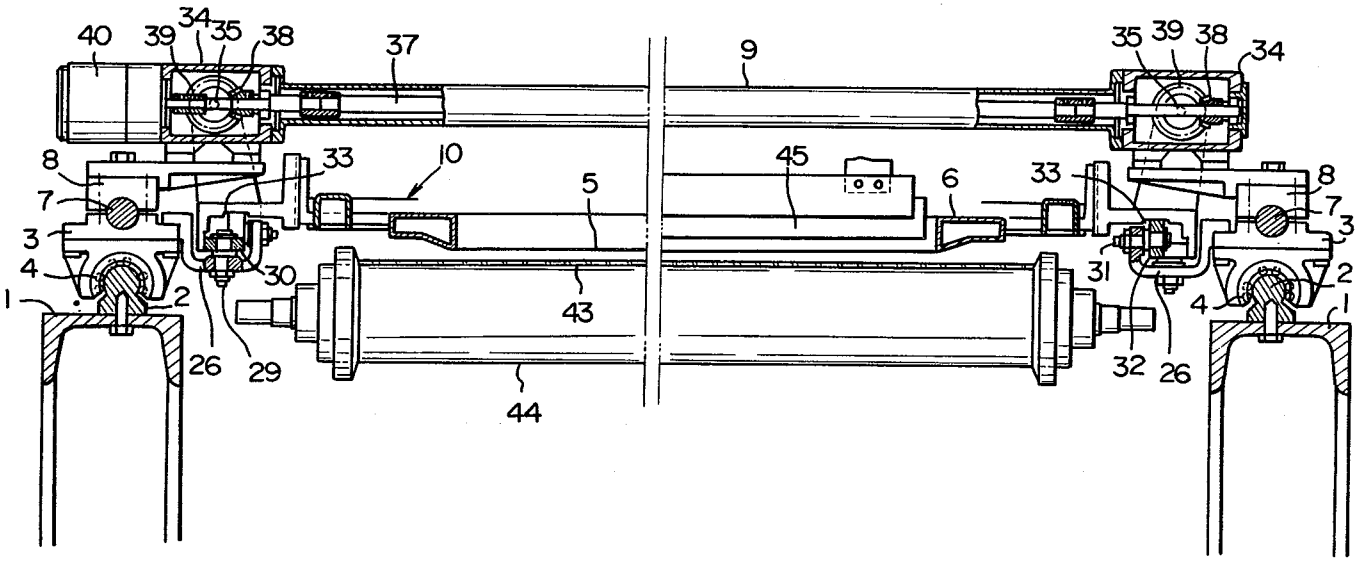
FIG. 2 is a view showing the section of the device of FIG. 1 taken along the cross-sectional direction of the machine frame.

Referring now to FIGS. 1 and 2, a pair of guide rails 2 are disposed to extend in the horizontal direction along the lengthwise direction of a machine frame 1, and a screen-supporting sliding member 3 is disposed through a slide bearing on the guide rails 2 so that it can be reciprocated in the horizontal direction along the guide rails 2. A set of four screen-supporting sliding members 3 corresponding to the four corners of a frame 6 supporting a screen 5 are disposed, and two pairs of the screen-supporting sliding members 3*a* and 3*b* disposed on both the sides, respectively, are spaced appropriately from screen-driving connecting rods 7 and fixed by clamping members 8. The two screen-supporting sliding members 3*a* disposed on the screen advance side (the upper side in FIG. 1) are connected to each other by a connecting rod 9 (see FIG. 2) extending in the cross-sectional direction of the machine frame.

A screen supporting member 10 for supporting the screen frame 6 includes connecting rods 11*a* and 11*b* extending in the cross-sectional direction of the machine frame and connecting rods 12 extending in the lengthwise direction of the machine frame. Three locating pins 13, 14 and 15 are mounted on the screen supporting member 10 to support the frame 6 in the precisely located state. The locating pin 13 disposed at the left upper corner in FIG. 1 is mounted on the front connecting rod 11*a* by an adjustment piece 16 so that its position can be adjusted in the widthwise direction. More specifically, a supporting piece 17 having the locating pin 13 has a female screw to be engaged with a widthwise direction adjustment screw 18 rotatably mounted on the adjustment piece 16, and the supporting piece 17 is pressed in a certain direction by a spring 19. The adjustment piece 16 is fixed to the front connecting rod 11*a* by a bolt 20. In this arrangement, when the widthwise direction adjustment screw 18 is turned, the locating pin 13 is moved in the widthwise direction and its position can be adjusted. The locating pin 14 disposed at the right upper in FIG. 1 is attached to a supporting piece 21 and this supporting piece 21 is fixed to the front connecting rod 11*a* by a bolt 20. The locating pin 15 disposed at the left lower corner in FIG. 1 is attached to a supporting piece 17 and mounted on the lower connecting rod 11*b* so that its position can be adjusted in the widthwise direction by means of adjustment piece 16, widthwise direction adjustment screw 18 and spring 19 such as mentioned above. Pin holes 23, 24 and 25 corresponding to these locating pins 13, 14 and 15, respectively, are formed on a flange of the screen frame 6. The pin hole 23 present at the left upper corner in FIG. 1 is a round hole arranged to fit the locating pin 13, and the pin hole 24 present at the right upper corner in FIG. 1 is a long pin hole extending in the widthwise or transverse direction. The pin hole 25 present at the left lower corner in FIG. 1 is a long pin hole extending in the lengthwise direction (the repeat direction) of the machine.

In the above arrangement, even if there is a certain dimensional error in the screen frame 6, the screen frame 6 can be set on the screen supporting member 10 assuredly in the precisely located state. Further, the position of the screen frame 6 in the widthwise direction can also be adjusted precisely by the adjustment screws 18.

One of characteristic features of the device of the present invention resides in that the screen supporting and driving system (screen supporting-sliding members 3*a* and 3*b*) and the screen supporting member 10 are arranged so that they can make relative movements in the lengthwise direction of the machine and both the members are connected to each other through the adjustment screw mechanism. This feature will now be described.

Referring to FIGS. 1 and 2 again, a bracket 26 is fixed to each screen-supporting sliding member 3 by suitable clamping means, and brackets 27 are disposed at the two front corners of the screen supporting member 10 and brackets 28 are disposed at the two lower corners of the screen supporting member 10. The brackets 27 and 28 fixed to the screen supporting member 10 are placed on the brackets 26 fixed to the screen-supporting sliding members 3 so that the brackets 26 in essence form a carriage. The brackets 27 and 28 are supported by the brackets 26 so that the position of each of the brackets 27 and 28 is not changed in either the vertical direction or the cross-sectional direction of the machine frame but each of the brackets 27 and 28 can be moved only in the lengthwise direction of the machine frame. More specifically, a roller 30 is mounted on each bracket 26 through a shaft 29 extending in the vertical direction and another roller 32 is mounted on the bracket 26 through a shaft 31 extending in the horizontal direction, so that the roller 30 is engaged with the vertical portions of the brackets 27 and 28 to set their positions in the cross-sectional (widthwise) direction of the machine and the roller 32 is engaged with grooves 33 formed on the lower faces of the brackets 27 and 28 to set their positions in the vertical direction. These rollers 30 and 32 can be rotated on the shafts 29 and 31, respectively, and accordingly, the screen supporting member 10 supported through the brackets 27 and 28 is allowed to move only in the lengthwise (repeat) direction of the machine.

In the portion 34 connecting the screen-supporting sliding member 3 and the connecting rod 9, there is turnably disposed an adjusting screw 35 extending in the lengthwise direction of the machine. A female screw 36 (see FIG. 1) to be engaged with the adjustment screw 35 is fixed to each of the brackets 27 mounted on the advance side of the screen supporting member 10. By this arrangement, the screen supporting member 10 is connected to the screen-supporting sliding member 3 and is allowed to make a relative movement in the lengthwise direction of the machine frame by turning of the adjustment screw 35.

The connecting rod 9 for the screen-supporting sliding members 3a has a hollow structure and a connecting shaft 37 is rotatably disposed in the interior of the rod 9. In both end portions of this connecting shaft 37, namely in the connecting portions 34, bevel gears 38 are fixed and they are engaged with bevel gears 39 fixed to the adjustment screws 35. A phase-adjusting geared motor 40 is mounted on one of the connecting portions 34 of the connecting rod 9, and its driving shaft is connected to one end of the connecting shaft 37.

When the phase-adjusting geared motor 40 is driven in the normal direction or the reverse direction, the connecting rod 37 is rotated in the same direction, whereby the adjustment screws 35 are turned in the normal direction or the reverse direction through the bevel gears 38 and 39 and the screen supporting member 10 is advanced or retreated through the female screws 36 engaged with the adjustment screws 35 and the brackets 27. Thus, the phase adjustment of the flat screen can be performed independently from the reciprocative movement of the screen.

The phase adjustment of the screen can even be performed mannually. For example, a knob 41 for manual adjustment is disposed in the engagement portion between the female screw 36 of the bracket 27 and the adjustment screw 35. The adjustment can similarly be accomplished by relatively turning the adjustment screw 35 and the female screw 36 by the knob 41. If such adjustment knobs 41 are arranged, the phase adjustment can be performed on both the sides independently.

Figure 3:
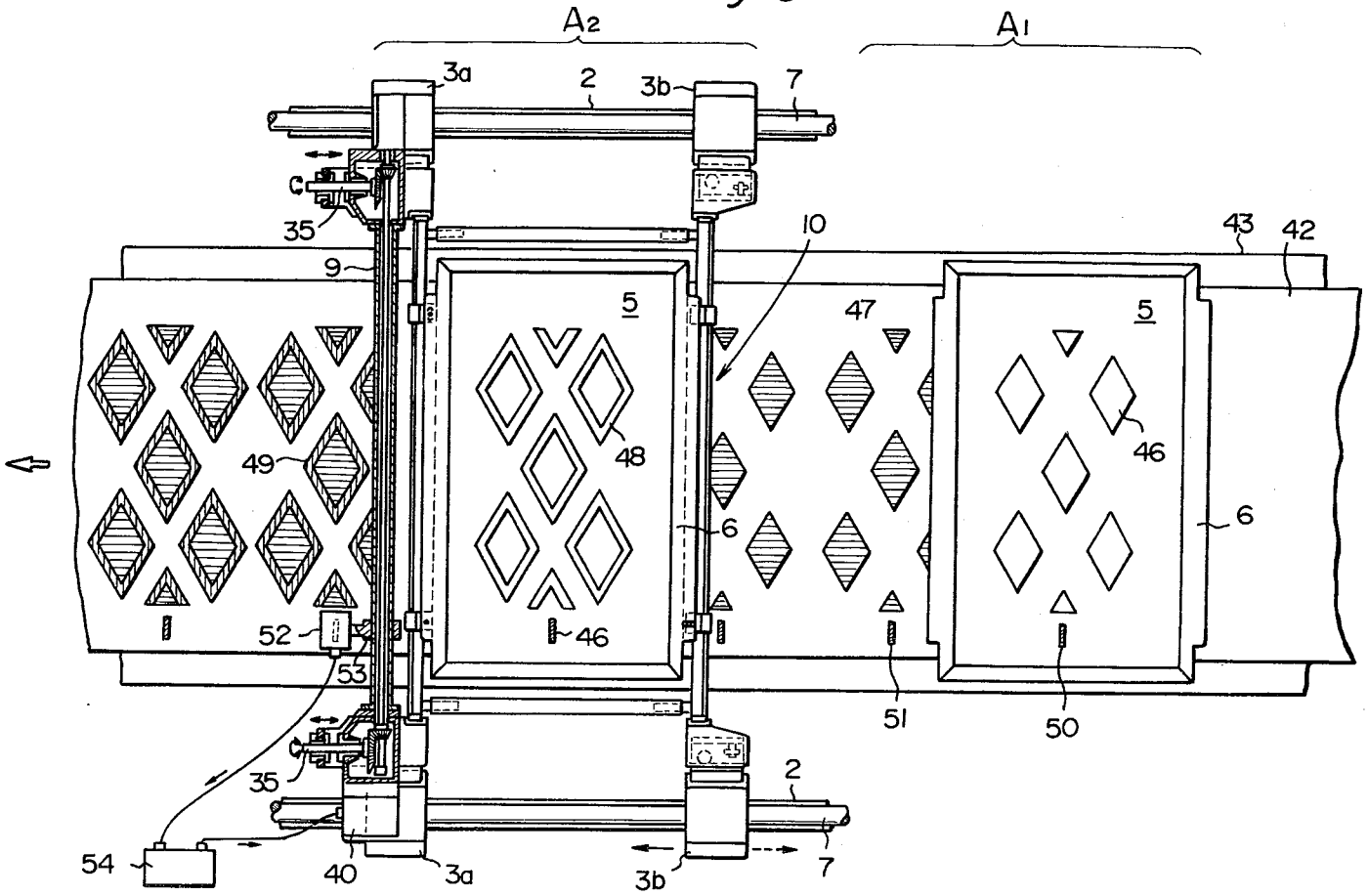
FIG. 3 is a plan view showing an embodiment where the device shown in FIGS. 1 and 2 is used in the state combined with an automatic control system.

The phase adjustment by driving of the phase-adjusting geared motor 40 can be performed automatically during the printing operation by using a phase detecting mechanism and a control mechanism in combination. This embodiment will now be described by reference to FIG. 3.

The material 42 to be printed is in the form of a web which is pasted on the surface of an endless belt 43 by a pasting roller (not shown), and the material 42 is supported and fed continuously at a constant speed in a certain direction (to the left in the drawings) into printing zones $A_1$ and $A_2$ by the endless belt 43. At the start of the printing operation, a plurality of flat screens 5 are moved in the same direction (to the left) as the moving direction of the material 42 at the same speed as the moving speed of the material 42. At this moment, a squeegee member 45 (see FIG. 2) is located at one end of the screen 5 (the left end in the drawings). A receiving roller 44 (see FIG. 2) disposed below the endless belt 43 is lifted up to the uppermost position to cause the material 42 on the endless belt 43 to come into contact with the screen 5. In this state, the squeegee member 45 is paired with the receiving roller 44 and they are moved in a direction (to the right in the drawings) reverse to the moving direction of the material 42 to perform printing on the moving material 42 through the screen 5.

When the squeegee member 45 arrives at the other end (the right end in the drawings) of the screen 5, the printing operation is completed, and the receiving roller 44 is lowered, whereby the contact of the material 42 with the flat screen 5 is released. The advance of the flat screen 5 is stopped and the screen 5 is then moved in a direction (to the right in the drawings) reverse to the moving direction of the material 42. The squeegee member 45 is held by a squeegee supporting mechanism (not shown) is exchanged with a doctor blade (not shown) and the squeegee supporting mechanism is moved in the same direction as the moving direction of the material 42, whereby the ink or paste on the screen 5 is returned to the printing-starting end. With this movement of the squeegee supporting mechanism, the receiving roller 44 is moved in the same direction as the moving direction ofthe material 42 at the lowered position thereof.

When the squeegee supporting mechanism arrives at one end (the left end in the drawings) of the screen 5, the return course movements of the flat screen 5 and the pair of the squeegee member 45 and the receiving roller 44 are stopped. In this state, the doctor blade is exchanged with the squeegee member 45 and the receiving roller 44 is lifted up, and the printing course movement of the screen 5 and squeegee member 45 is started. Thus, the foregoing operations are continuously repeated. In this automatic screen printing machine of the continuous feed type, during a period from the start of the printing operation to the start of the printing operation of the next cycle, the material 42 to be printed is moved by a distance corresponding to the length of one repeat, and the material 42 can be printed in a continuous manner.

The flat screen positioned in the first printing operation zone $A_1$ has a stencil pattern 46 corresponding to a first color pattern, and this first color pattern 47 is printed on a material 42 to be printed. The flat screen positioned in the second printing operation zone $A_2$ has a stencil pattern 48 corresponding to a second color pattern, and this second color pattern 49 is printed on the material 42 to be printed. In order to prevent shears of color patterns, a register mark or indicating mark 50 is formed on one side of each screen and a corresponding register mark 51 is formed on the side edge of the material 42. Register marks 51 formed on the material 42 are spaced from one another at prescribed intervals. The interval between the two adjacent register marks 51 is equal to the length of one repeat if the timings of the respective operations and the positions of the respective members in the printing machine are precisely set accordantly with one another. The phase adjusting mechanism described hereinbefore by reference to FIGS. 1 and 2 is mounted on the screen-supporting sliding member in the second printing operation zone. A photoelectric detecting mechanism 52 is attached to the connecting rod 9 through a suitable arm 53 to detect or sense the register mark 51 printed on the material 42. This photoelectric detecting mechanism 52 is disposed at such a position that it detects the register mark 51 only when the flat screen in the second printing operation zone is precisely located at the prescribed point. A signal from the photoelectric detecting mechanism 52 is introduced into a known control mechanism 54, and power is applied to the phase-adjusting geared motor 40 capable of rotating in the normal and reverse directions through this control mechanism 54.

During the printing step, namely when the flat screen 5 is moved at the same speed as that of the material 42 in the same direction as the moving direction of the material 42, preferably at the start of the printing step, the photoelectric detecting mechanism 52 detects the register mark 51 on the material 42 to cause the control mechanism 54 to drive the phase-adjusting geared motor 40. More specifically, when there is a positional deviation between the photo-electric mechanism 52 and the register mark 51, the control mechanism 54 drives the geared motor 40 so as to get rid of this deviation. For example, the phase of the screen 5 in the second printing operation zone $A_2$ is delayed, the geared motor 40 is caused to drive the adjustment screw 35 so that the screen 5 supported on the screen supporting member 10 is moved in the direction of advance of the material 42. In contrast, when the phase of the screen 5 is put forward, the geared motor 40 is caused to drive the adjustment screw 35 so that the screen 5 is moved in the direction reverse to the direction of advance of the material 42.

As will be apparent from the foregoing illustration, according to the present invention, adjustment of the phase of the flat screen can be performed independently from the screen driving system even while the printing operation is being conducted by moving the screen reciprocatively in the horizontal direction.

The device of the present invention for adjusting the phase of a flat screen is especially valuable for an automatic screen printing machine of the type where a material to be printed is continuously fed and the flat screen is moved reciprocatively. However, it will readily be understood that the advantage of the present invention that adjustment of the phase of a flat screen can be performed independently from the screen driving system even during the printing operation can similarly be attained even when the present invention is applied to an automatic flat screen printing machine of the type where a material to be printed is intermittently fed into the printing operation zone.

What I claim is:

1. A flat screen printing machine wherein a web of material is advanced in a first direction past a printing station wherein said printing station includes:

a printing screen for printing a pattern on said web;

carriage means for supporting said printing screen above said web;

drive means for moving said carriage means and said printing screen at the same speed as said web so that the pattern on the printing screen can be transferred to said web accurately during printing;

means for mounting said printing screen on said carriage means wherein said mounting means includes means allowing relative movement between said screen and said carriage means;

adjustment means for driving said screen to move relative to said carriage both with and opposite to the direction of carriage motion;

indicating means on said web;

detector means rigidly mounted with said screen for sensing misalignment with said indicating means, and motor means activated by said detector means to drive said adjustment means until said detector means is aligned with said indicating means so that the pattern on said screen remains properly aligned with the web during the printing process.

2. The flat screen printing machine of claim 1 wherein the indicating means on said web are a plurality of equally spaced marks and wherein the detector means is a photo-electric device which generates a drive signal when not registered with a mark.

3. The screen printing machine of claim 2 wherein the adjustment means includes a screen frame and a pair of screws journalled with respect to the screen frame and threaded with respect to the carriage wherein when the screw is turned the screen is displaced relative to the carriage.

4. The screen printing machine of claim 3 wherein the adjustment screws are disposed on opposite sides of the screen and are mutually driven by a shaft which extends between the screws in a direction normal to the advancement of the carriage.

5. The screen printing machine of claim 4 wherein the carriage means rests on a pair of parallel tracks and wherein the means for mounting the screen includes a bracket with roller means disposed between the bracket and carriage to facilitate relative movement as the adjustment screws are rotated.

6. The screen printing machine of claim 1 wherein the means for mounting the screen includes three triangularly spaced locating pins and wherein the screen includes a screen supporting frame having a hole and two slots therein, in which the pins individually register, wherein the hole receives one pin to form a fixed pivot, wherein one of the slots is laterally displaced from the pivot with respect to the direction of screen motion and extends transversely with respect to the direction of screen motion and wherein the other slot is displaced from the pivot in the direction of motion and extends transversely, and means for adjusting the relative position of lack of said pins to determine the position of the frame accurately.

7. The flat screen printing machine of claim 6 wherein the pin forming the pivot is mounted on a threaded support which is moved laterally by a screw and wherein the pin registered with the second slot is mounted on a threaded support which is also moved laterally by a screw in order to form the means for adjusting the relative position of the pins.

* * * * *